US009038517B2

(12) United States Patent
Lucas et al.

(10) Patent No.: US 9,038,517 B2
(45) Date of Patent: May 26, 2015

(54) MANDOLIN SLICER

(75) Inventors: Tommie Lucas, Beaverton, OR (US); Neil Hollis Slater, Yamhill, OR (US); Dennis Lee Epstein, Ridgefield, WA (US)

(73) Assignee: KAI U.S.A LTD., Tualatin, OR (US)

( * ) Notice: Subject to any disclaimer, the term of this patent is extended or adjusted under 35 U.S.C. 154(b) by 1011 days.

(21) Appl. No.: 11/634,621

(22) Filed: Dec. 6, 2006

(65) Prior Publication Data

US 2007/0125207 A1 Jun. 7, 2007

Related U.S. Application Data

(60) Provisional application No. 60/748,092, filed on Dec. 6, 2005.

(51) Int. Cl.
*B26D 3/28* (2006.01)

(52) U.S. Cl.
CPC ..... *B26D 3/283* (2013.01); *B26D 2003/285* (2013.01); *B26D 2003/286* (2013.01); *B26D 2003/287* (2013.01); *B26D 2003/288* (2013.01)

(58) Field of Classification Search
USPC ..... 83/247, 422, 431, 435.12, 425, 83/435.15–435.19, 856–858, 437.1, 437.7, 83/441.1, 554, 564, 657, 703, 704, 707, 83/708, 717, 932, 437.2, 437.3, 437.4, 83/437.5, 437.6; 269/6; 16/426; 30/280, 30/289, 294
IPC ..... B26D 3/283
See application file for complete search history.

(56) References Cited

U.S. PATENT DOCUMENTS

| | | | | | |
|---|---|---|---|---|---|
| 126,115 | A * | 4/1872 | Weed et al. | 83/730 |
| 1,358,020 | A * | 11/1920 | Rosinsky | 83/145 |
| 1,626,550 | A * | 4/1927 | Miller | 83/404.3 |
| 1,893,905 | A * | 1/1933 | Porter | 83/717 |
| 1,915,869 | A | 6/1933 | Rowley | |
| 2,102,859 | A * | 12/1937 | Spousta | 83/167 |
| 2,604,915 | A * | 7/1952 | Beavers | 83/719 |
| 2,685,315 | A * | 8/1954 | Winberg | 83/717 |
| 2,912,757 | A * | 11/1959 | Knight | 30/303 |
| D190,051 | S * | 4/1961 | Lundell | D7/383 |
| 3,442,312 | A | 5/1969 | Karp | |
| D249,044 | S | 8/1978 | Popeil | D15/97 |
| 4,397,206 | A * | 8/1983 | Czala | 83/399 |
| D326,388 | S | 5/1992 | Boerner | D7/381 |
| 5,615,591 | A * | 4/1997 | Scherch et al. | 83/399 |
| 5,662,019 | A * | 9/1997 | Denman | 83/425 |
| 6,167,791 | B1 * | 1/2001 | Heckman et al. | 83/719 |
| 6,845,697 | B2 * | 1/2005 | Kovacs | 83/62 |
| D503,314 | S | 3/2005 | Wong | D7/673 |
| 7,107,890 | B2 * | 9/2006 | Vincent | 83/247 |
| 2004/0200366 | A1 * | 10/2004 | Koerselman et al. | 99/537 |
| 2004/0216579 | A1 | 11/2004 | Zeder et al. | 83/698.11 |
| 2005/0045011 | A1 | 3/2005 | Kovacic et al. | 83/478 |
| 2006/0075872 | A1 * | 4/2006 | Wangler | 83/856 |

* cited by examiner

*Primary Examiner* — Kenneth E Peterson
(74) *Attorney, Agent, or Firm* — Seed IP Law Group PLLC

(57) ABSTRACT

A mandolin slicer having one or more safety features, including a food carrier having one or more guards to protect a user's hand and a food carrier delivery system that helps ensure uniform and predictable movement. The mandolin slicer also provides an ability to safely and effectively cut oversized, long, and awkwardly shaped food articles.

16 Claims, 17 Drawing Sheets

MANDOLIN SLICER

CROSS-REFERENCE TO RELATED APPLICATION

This application claims the benefit under 35 U.S.C. § 119 (e) of U.S. Provisional Patent Application No. 60/748,092 filed Dec. 6, 2005, which application is incorporated herein by reference in its entirety.

BACKGROUND OF THE INVENTION

1. Field of the Invention

The disclosed invention is generally related to the field of food preparation devices, and in particular to a novel food slicer with improved safety features and a method of using the improved slicer.

2. Description of the Related Art

There are numerous mandolin slicers in the market, but all present a substantial risk of injury to a hand of a user operating the slicer. Despite numerous mandolin slicers in the art, there is still a need for a slicer that will reduce the risk of injury and increase the safety for the user. Moreover, there is a need for a slicer that allows various sizes of food articles to be cut, such as oversized food articles or awkwardly shaped articles, while providing safety for the user.

BRIEF SUMMARY OF THE INVENTION

In one embodiment, a food carrier is coupled to a food carrier rail that runs along a length of the mandolin slicer. This carrier rail provides stability and uniform movement for the food carrier as the food carrier moves back and forth along the mandolin slicer. This stability and uniform movement also helps improve safety for the user.

In one embodiment, the food carrier is rotatably coupled to the carrier rail on only one side, thus allowing the food carrier to rotate around a longitudinal axis of the carrier rail. This rotatable coupling allows the food carrier to be rotated away from the food deck of the mandolin slicer, thereby providing easy access to insert food or to fit oversized shaped food articles to be sliced onto the food deck. The food carrier can then be rotated back over the mandolin slicer and onto a portion of the food article to be sliced. In this way, the food can be easily placed on the food deck to be sliced by movement of the food carrier. Further, the size of the food article to be cut or sliced is not limited by the size of a volume inside the food carrier because the food carrier can be lifted and rotated up providing an even greater volume below for the food article.

In an embodiment, a front portion of the food carrier is open so that portions of long food articles can fit underneath and be held by the food carrier during operation. Length of the food carrier therefore does not limit the length of the food article that can be cut by the mandolin slicer. Also described herein are new methods of using a mandolin slicer, which are made possible by one or more of the improvements provided in this disclosure.

The mandolin slicer described herein can be used to safely cut many types of food in many different shapes and sizes. The food articles cut by the mandolin slicer may be any type of food that a user desires to slice or cut, including but not limited to fruit, vegetables, meat, and breads. Also, because of the unique features of this mandolin slicer, including but not limited to the improved food carrier and food carrier delivery system, the size and shape of the food to be cut is less of a limiting factor. The user can still safely operate the mandolin slicer even if the food to be cut or sliced is oversized or larger than the food carrier (such as a large non-uniform potato), long or extending outside the food carrier (such as a large carrot), or any shape (for example square, trapezoidal, circular, or oblong).

In an embodiment, a user handle is also provided that is advantageously positioned on the food carrier so that a user's hand operating the mandolin slicer is not in proximity to a cutting mechanism of the slicer. The handle is positioned off to a side of the food deck of the mandolin slicer such that during operation of the slicer, the user's hand moves the handle back and forth in a plane that is not over the cutting mechanism of the slicer. This advantageous positioning of the food carrier handle helps ensure that the user's hand does not pass over the cutting mechanism, minimizing the risk of cuts to the user's hand.

The improved food carrier also has, in an embodiment, a stop tab or stop-shelf over a bottom portion of the food carrier that helps prevent fingers of the user from coming in contact with the cutting mechanism while the food carrier is moved back and forth over the mandolin slicer. A user could potentially place one or more fingers on a back of the food carrier during operation. The stop tab extends out from the bottom portion of the food carrier providing a barrier between the cutting mechanism and a user's fingers that may be resting on the back of the food carrier. The stop tab thereby helps prevent the user's fingers from coming in contact with the cutting mechanism during operation as the food carrier passes over the cutting mechanism.

The mandolin slicer thus has a food carrier delivery system that helps ensure uniform and predictable movement, while also providing an ability to safely and effectively cut oversized, long, and awkwardly shaped food articles.

BRIEF DESCRIPTION OF THE DRAWINGS

The drawings discussed in the detailed description of this invention are described briefly as follows, in which.

DETAILED DESCRIPTION OF THE INVENTION

Figure 1:
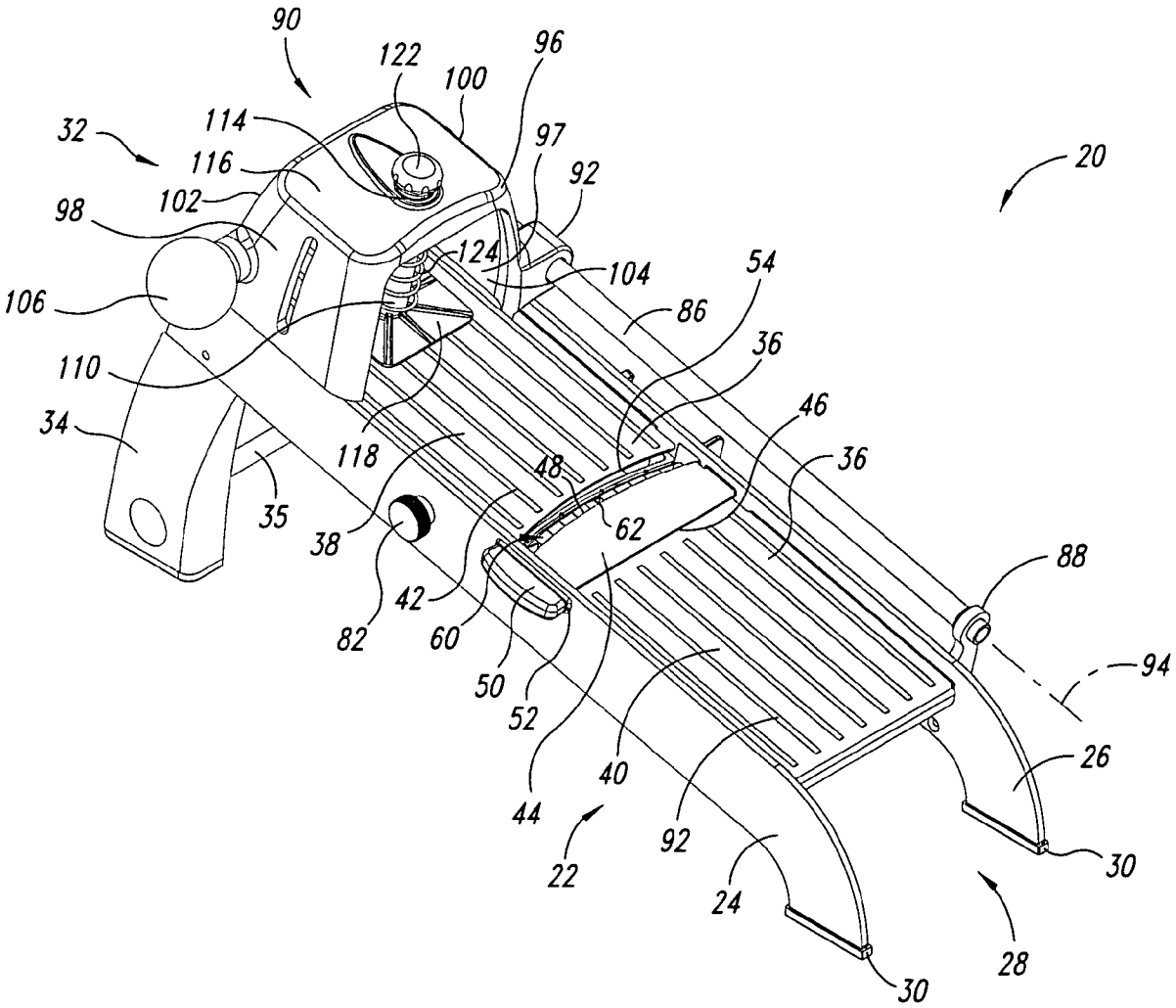
FIG. 1 is a perspective view of a mandolin slicer according to an embodiment.

A mandolin slicer 20 according to embodiments of the invention is shown and described with reference to FIGS. 1-17. As used herein, the term mandolin broadly refers to a food cutter or slicer, and the terms cutter, cut, slicer, and slice are used to broadly refer to removing a piece from a larger whole; no particular shape or consistency of the piece removed should be inferred by the terms. The mandolin slicer 20 can be made of any appropriate material, including but not limited to one or more of the following: metal, plastic, wood, or composition.

FIGS. 1-6 show perspective views of a mandolin slicer 20. The mandolin slicer 20 includes a frame 22 that has a front rail 24 (also called a first frame member) and a back rail 26 (also called a second frame member), where the rails 24 and 26 are opposing and substantially parallel. Each rail 24 and 26 has an elongated body that transverses the mandolin slicer 20, terminating at a distal end 28 of the mandolin slicer 20.

At the distal end 28, the rails 24 and 26 are formed into a pair of feet 30 that support the distal end 28 of the mandolin slicer 20. At a proximate end 32 of the mandolin slicer 20, the rails 24 and 26 terminate and are coupled to a pair of legs 34.

Extending between the legs 34 and coupled to each leg 34 is a stabilizing bar 35. The stabilizing bar 35 also provides a gripping point for a user to hold and stabilize the mandolin slicer 20 in place when in use. Each of the legs 34 are coupled with a hinge or pivot to the rails and thus configured to fold under the mandolin slicer 20 for storage.

In an embodiment, the feet 30 are shorter than the legs 34 so that the mandolin slicer 20 is arranged at a downward angle. Also, the feet 30 and legs 34 can cooperate to stand the mandolin slicer 20 above a container (not pictured).

Disposed between and coupled to the rails 24 and 26 is a food deck 36 having a first food support surface 38 (also called a first food deck) at the proximate end 32 of the mandolin slicer 20 and a second food support surface 40 (also called a second food deck) at the distal end 28 of the mandolin slicer 20. The first and second food support surfaces 38 and 40 are generally rectangular in shape with substantially equal widths, fitting between and coupling to the rails 24 and 26 to form a substantially rigid body. In alternative embodiments, the first and second food support surfaces 38 and 40 can be any combination of shapes or widths, for example trapezoidal or circular with substantially different widths configured to work cooperatively to slice or cut food. Moreover, the food deck can have more than the first and second food support surfaces 38 and 40; for example multiple food support surfaces can be configured in series or parallel to cooperatively slice or cut food.

In embodiments, the rails 24 and 26 are also coupled together by support members 41 (shown for example in FIGS. 5 and 6) that extend across the distance between the rails 24 and 26. The support members 41 are located beneath and provide support for at least a portion of the first and second food support surfaces 38 and 40.

In an embodiment, the first and second food support surfaces 38 and 40 each have a plurality of longitudinal parallel guide ribs 42 formed thereupon that are raised and configured to allow a piece of food to easily slide along the guide ribs 42 and first and second food support surfaces 38 and 40. The first and second food support surfaces 38 and 40 can be provided with a low friction coating, such as Teflon®, to reduce sticking of food on the support surfaces 38 and 40.

The mandolin slicer 20 has a cutting member 44 that is removably fixed between the rails 24 and 26 and is positioned between the first and second food support surfaces 38 and 40. Referring to FIGS. 1-4, in an embodiment, the cutting member 44 is a substantially flat blade having a substantially straight non-sharpened end 46 and a substantially convex cutting edge 48 (also called a sharpened end). Coupled to a side portion of the cutting member 44 is a blade handle 50 configured to allow a user to hold the cutting member 44 by the blade handle 50 and insert the cutting member 44 into the mandolin slicer 20.

In an embodiment, the front rail 24 has a blade receiving opening 52 that is configured to receive the cutting member 44. The blade receiving opening 52 is disposed on the front rail 24 between the first and second food support surfaces 38 and 40 and is positioned so that when the cutting member 44 is placed within the blade receiving opening 52, the cutting member 44 is substantially co-planar with at least the second food support surface 40. The blade receiving opening 52 has a width and depth that is approximately equal to a width and depth of the cutting member 44 so that the blade receiving opening 52 can receive and hold the cutting member 44 and hold it in place (shown for example in FIGS. 1 and 2). In some embodiments, when the cutting member 44 is placed within the blade receiving opening 52, the cutting edge 48 is proximate a trailing edge 54 of the first food support surface 38 and the non-sharpened end 46 is proximate the second food support surface 40.

In some embodiments, to help stabilize the cutting member 44 when it is positioned within the blade receiving opening 52, the back rail 26 has a ledge 56 (shown for example in FIG. 4) cut into an inside portion, where the ledge 56 is configured to receive a tapered edge 58 of the cutting member 44. Thus, the cutting member 44 is supported on the tapered edge 58 by the back rail 26 and the other edge of the cutting member 44 at the blade handle 50 is supported by the blade receiving opening 52 of the front rail 24. The blade receiving opening 52 and the ledge 56 are substantially aligned so that the cutting member 44 is substantially co-planar with the second food support surface 40 when inserted into the mandolin slicer 20.

In another embodiment, the cutting member 44 is supported in part by a tapered ledge 59 (shown for example in FIGS. 3 and 4) formed on the second food support surface 40. In this embodiment, the tapered ledge 59 is a portion of second food support surface 40 that is in a plane below and parallel to the rest of the second food support surface 40. The tapered ledge 59 is also proximate to and below the blade receiving opening 52 so that at least a portion of the cutting member 44 is supported by the tapered ledge 59 when the cutting member 44 is inserted into the blade receiving opening 52. Thus, either ledge 56 or ledge 59 can be provided, or both.

In embodiments, the mandolin slicer 20 has a second cutting member 60 (shown for example in FIGS. 3 and 4) that is removably fixed between the rails 24 and 26 and is positioned between the first and second food support surfaces 38 and 40. In an embodiment, the second cutting member 60 is between the first food support surface 38 and the cutting edge 48 of the cutting member 44. The second cutting member 60 has a plurality of blades 62 that cooperate with the cutting member 44 to slice an article of food that is passed over the blades 62 and cutting member 44. In an embodiment, the second cutting member 60 has an elongated curved body portion 64 with the plurality of blades 62 vertically disposed and parallel to one another on an upper surface 66 of the second cutting member 60. On one end of the elongated curved body portion 64 is a second cutting member handle 68 configured to allow a user to insert the second cutting member 60 into the mandolin slicer 20. In embodiments, the second cutting member 60 is a julienne slicer with a plurality of blades that can be spaced apart by ⅛, ¼, or ½ inch.

In embodiments, the mandolin slicer 20 has a second cutting member receiver 70 (shown for example in FIGS. 4-6) disposed between and attached at both ends to the front and back rails 24 and 26. The second cutting member receiver 70 has an elongated curved body portion in a U-shape that is configured to hold and support the second cutting member 60. In embodiments, the second cutting member receiver 70 is disposed in a plane beneath the beneath first and second food support surfaces 38 and 40 and is configured such that the upper surface 66 of the second cutting member 60 is co-planar with at least the cutting member 44 and the second food support surface 40 when inserted into the second cutting member receiver 70. In an embodiment, the back rail 26 has an opening 72 (shown for example in FIGS. 3 and 4) that leads to the second cutting member receiver 70 and is configured to receive the second cutting member 60 when a user places it into the mandolin slicer 20.

In embodiments, the cutting member 44 or the second cutting member 60 may be used alone or in combination. For example, the mandolin cutter 20 can be used with only cutting member 44, only with cutting member 60, or with both cutting members 44 and 60. Moreover, the mandolin cutter 20 can be configured to only offer one or the other cutting members 44 and 60, or multiples of the same cutting member 44 or 60. For example, an embodiment can have a series of three or four food support surfaces with a single or multiple cutting members 44 and/or 60 between one or more sets of food support surfaces.

The blades used in the figures are exemplary and can be substituted with any number of blades or cutting utensils depending on the desired cut of the food article. For example, blades may be used in the cutting member 44 or the second cutting member 60 that are horizontal, vertical, curved, straight, thin, thick, raised, flat, v-shaped, trapezoidal-shaped, or a variety of other shapes and thicknesses that are well-known in the art. Also, the cutting members 44 and 60 being removably coupled to the mandolin slicer 20 in a way that the cutting members 44 and 60 are easily slide in and out of the mandolin slicer 20, the cutting members 40 and 60 are able to be quickly and conveniently removed and cleaned after each use, and can be easily removed from the mandolin slicer 20 for sharpening and maintenance, thereby adding to the long-term performance of the mandolin slicer 20.

By having cutting mechanisms 44 and 60 that can be easily maintained, the safety of the mandolin slicer 20 is improved because a user can insure that a clean, sharpened blade is being used and that the performance of the mandolin slicer 20 is maximized. In embodiments, one or more of the cutting mechanisms 44 and 60 can be stationary blades, or, in other embodiments, the cutting mechanisms 44 and can be rotating, moving, or mechanically driven blades.

Figure 2:
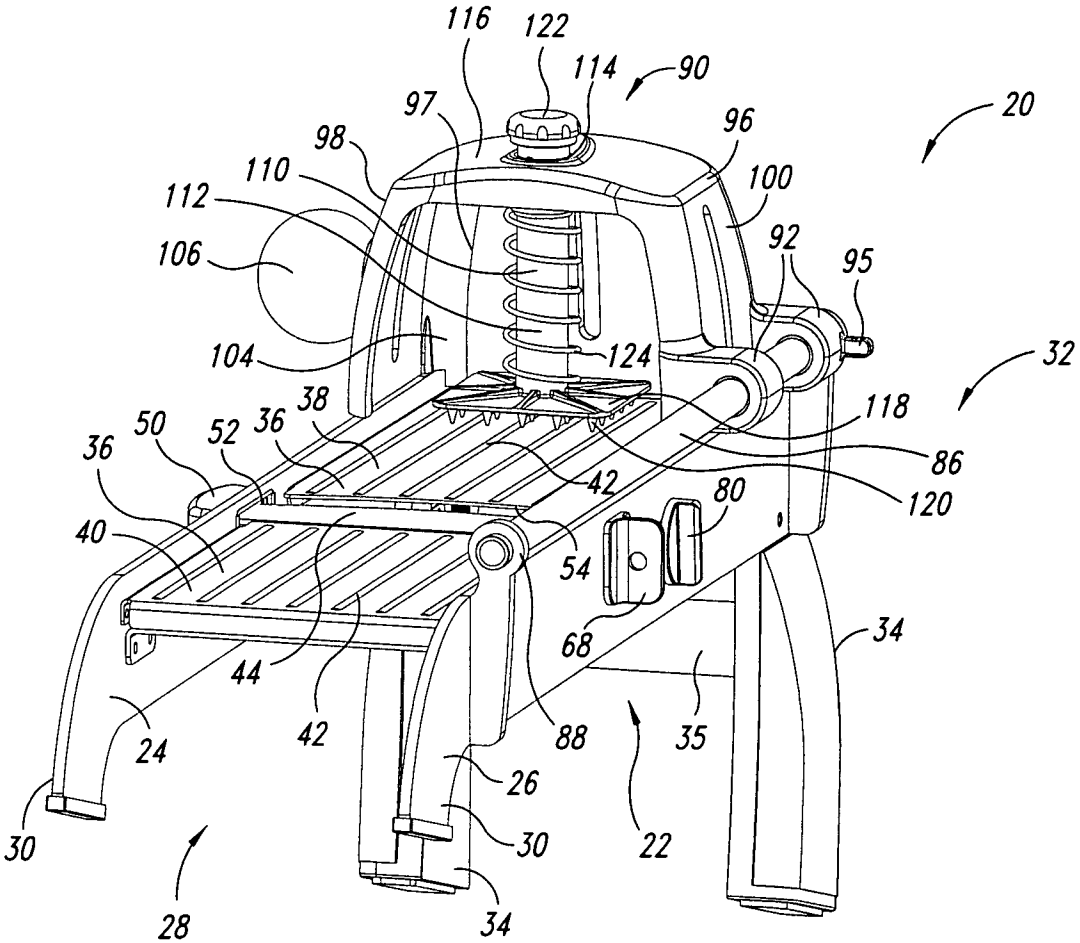
FIG. 2 is a perspective view of a mandolin slicer according to an embodiment.
Figure 3:
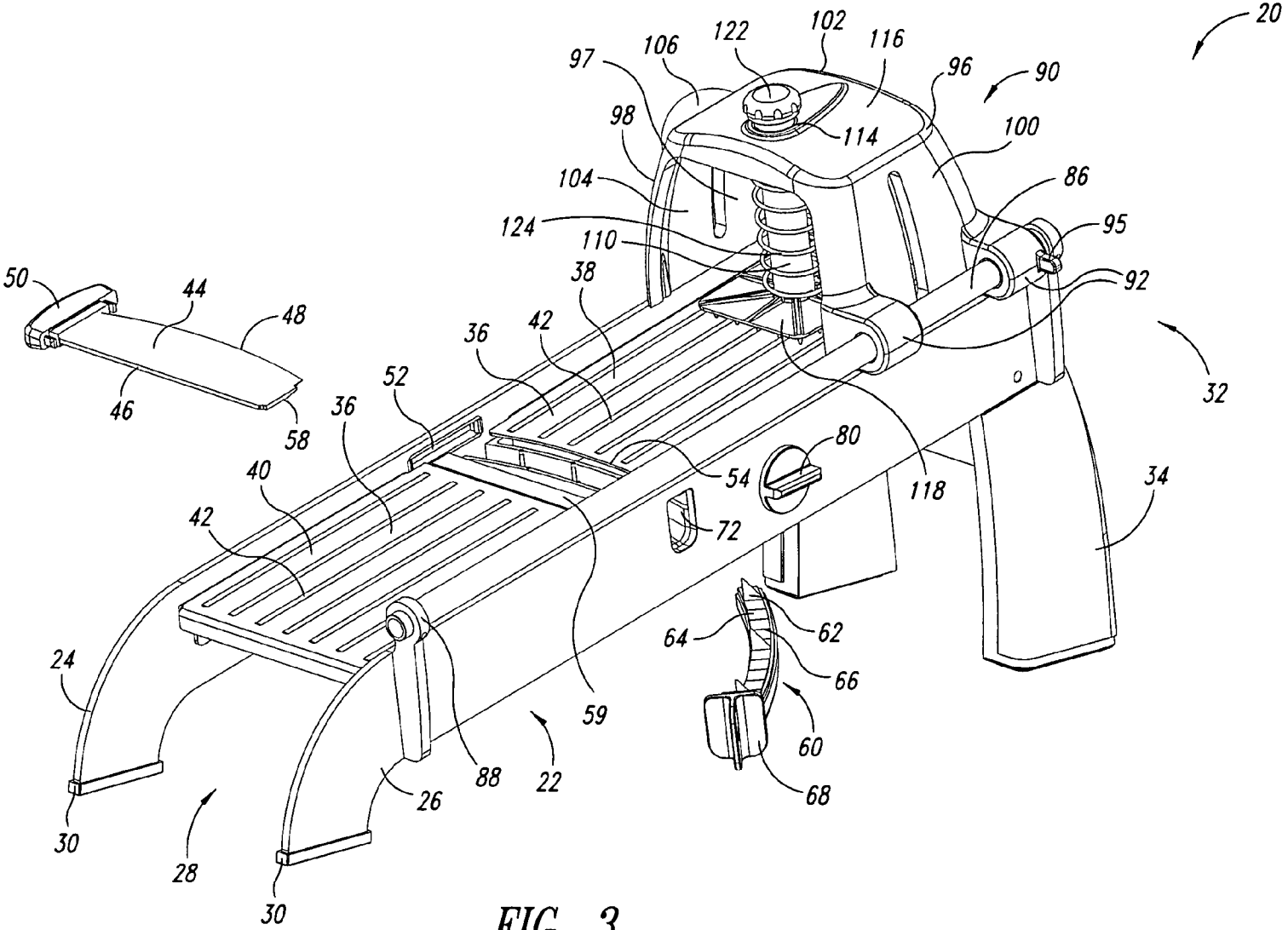
FIG. 3 is a perspective view of a mandolin slicer according to an embodiment, with the cutting members removed.
Figure 4:
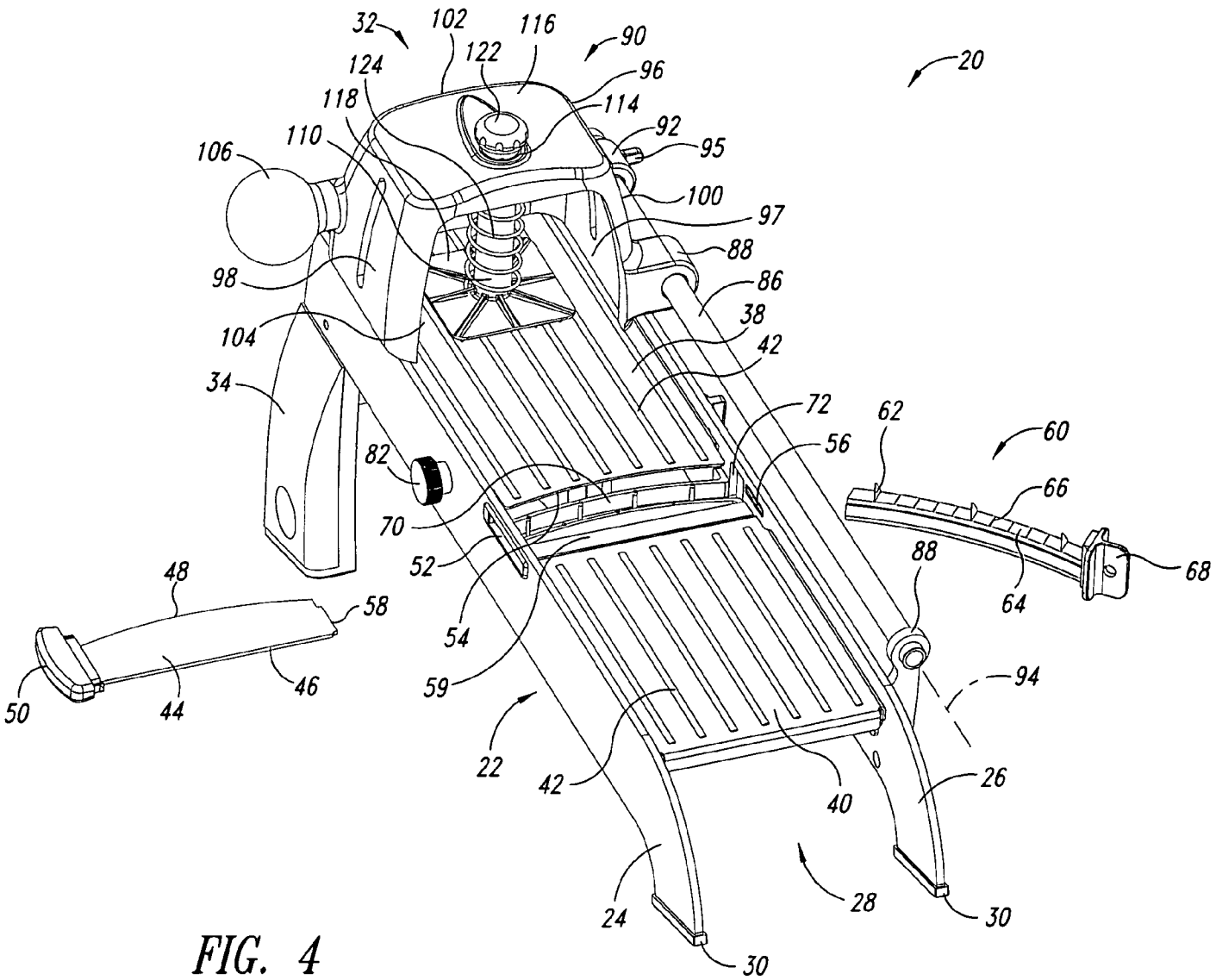
FIG. 4 is a perspective view of a mandolin slicer according to an embodiment, with the cutting members removed.
Figure 5:
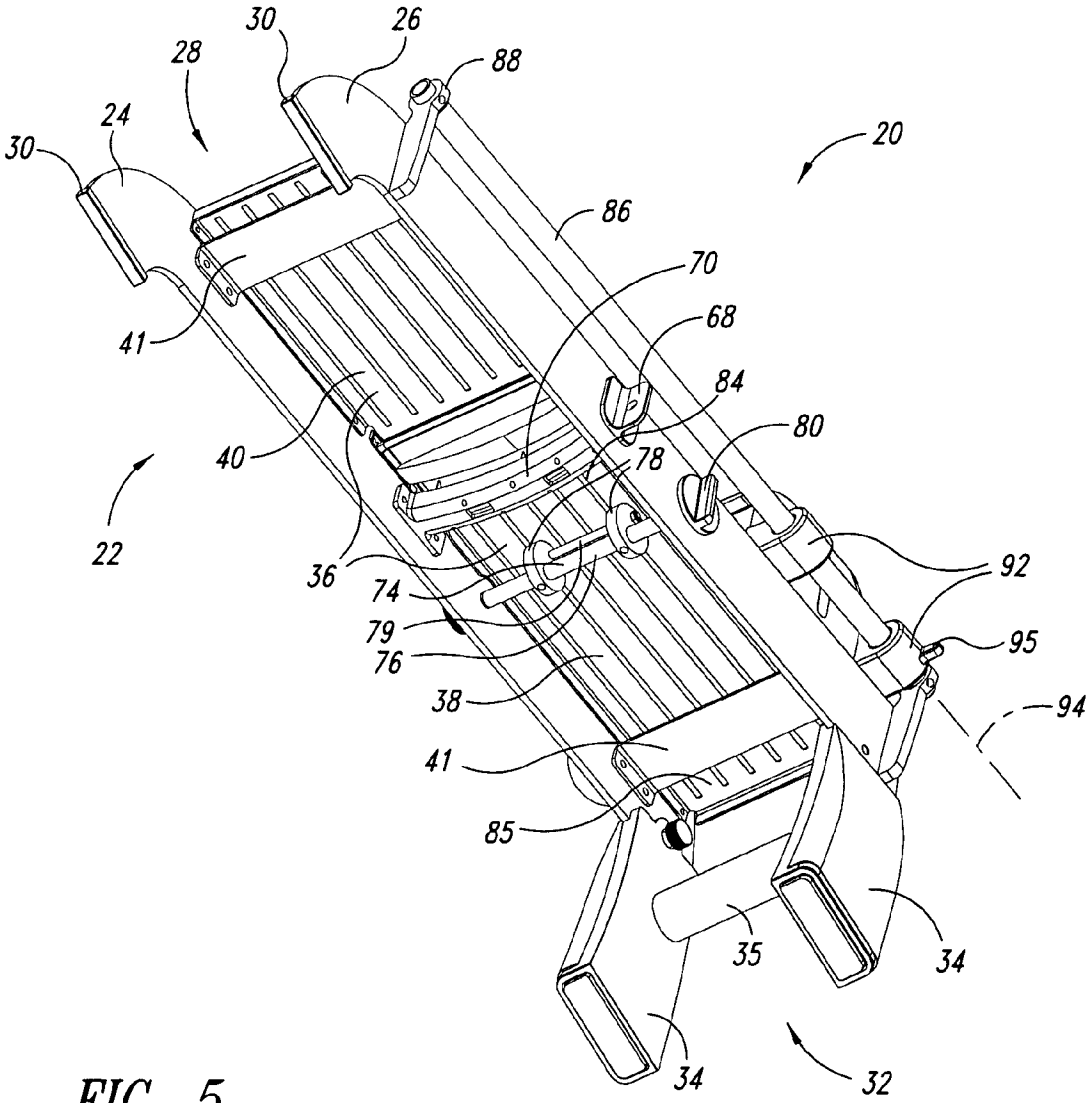
FIG. 5 is a perspective view of a mandolin slicer according to an embodiment showing an underside of the slicer.
Figure 6:
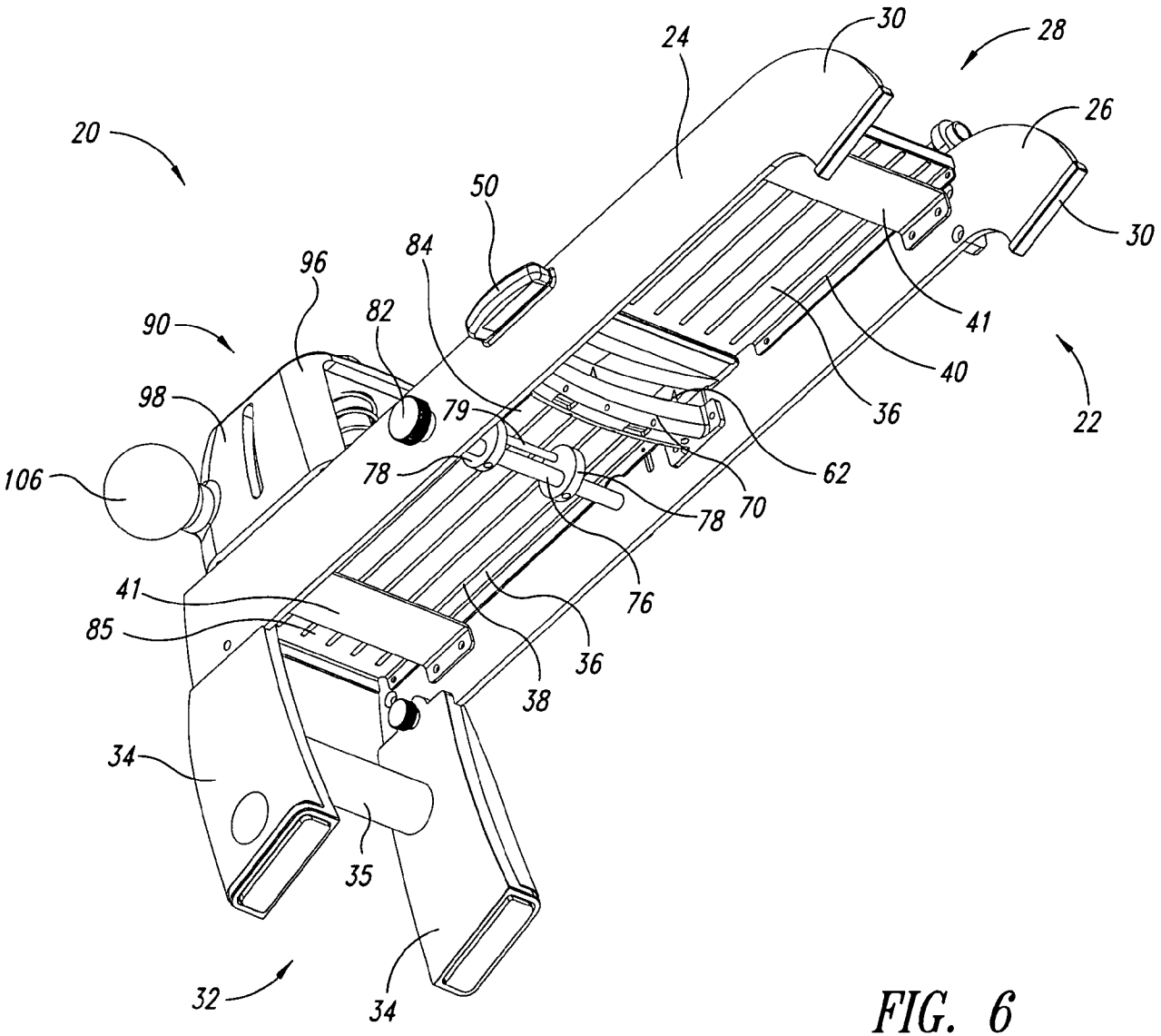
FIG. 6 is a perspective view of a mandolin slicer according to an embodiment showing an underside of the slicer.

Referring to FIGS. 5 and 6, the mandolin slicer 20 is also provided in embodiments with a slicing thickness mechanism 74 that is configured to adjust a thickness of a slice taken from a food article that is passed across the cutting member 44 (shown for example in FIGS. 1 and 2). In embodiments, the slicing thickness mechanism 74 has a camshaft 76 carrying a cam 78. In an embodiment, the camshaft carries a plurality of cams 78 and the cams 78 are coupled together by a stability rod 79.

The camshaft 76 is coupled to an adjustment knob 80 that is configured to turn the camshaft 76 and the cam 78. The adjustment knob 80 is provided to permit infinite adjustment of the slicing thickness between about zero and about one-half inch. In other embodiments, the slicing thickness is between about zero and about one inch. In embodiments, the adjustment knob 80 is located proximate an outer portion of the back rail 26 with an end portion of the camshaft 76 passing through an opening in the back rail 26 and coupling to the adjustment knob 80. An opposite end of the camshaft 76 passes through an opening in the front rail 24 and is coupled to a holding bit 82 on the outside of the opening in the front rail 24.

In an embodiment, the slicing thickness mechanism 74 can be used to provide structural stability for the mandolin slicer 20. For example, the camshaft 76, adjustment knob 80 and holding bit 82 can be configured with the frame 22 such that when the holding bit 82 is tightened, the rails 24 and 26 are forced against at least the first food support surface 38, thereby providing a holding force to help keep the first food support surface 38 in the position selected with the slicing thickness mechanism 74 (i.e., cam 78 position selected with the adjustment knob 80). The holding bit 82 may also be loosened to allow the forward end 84 of the first food support surface 38 to move up and down, and then the holding bit 82 can be tightened again to help hold the first food support surface 38 in place and to provide structural stability to the mandolin slicer 20 during use.

In an embodiment, the camshaft 76 is positioned under a forward end 84 of the first food support surface 38 proximate the cutting member 44. In this embodiment, the forward end 84 of the first food support surface 38 is free to move up and down with the cam 78 providing a lower limit for movement, and a rearward end 85 of the first food support surface 38 is rotatably coupled to the frame 22 at the proximate end 32 of the mandolin slicer 20. Support for the first food support surface 38 is provided then at the rearward end 85 by the rotatable coupling to the frame 22 and support member 41 at the proximate end 32 of the mandolin slicer 20, and at the forward end 84 of the first food support surface 38 by the camshaft 76 and cam 78 where gravity and a user exerting downward force on the first food support surface 38 during use presses the forward end 84 down on the cam 78. Thus, a user can adjust the vertical spacing between the trailing edge 54 of the first food support surface 38 and the cutting edge 48 of the cutting member 44 by rotating the adjustment knob 80, thereby moving the forward end 84 of the first food support surface 38 up or down.

In alternative embodiments, multiple camshafts 76 can be provided. For example one camshaft 76 can be under the first food support surface 38 and another camshaft 76 can be under the second food support surface 40. In this embodiment, the vertical distance between both the first and second food support surfaces 38 and 40 can be varied with respect to the cutting members 44 and 60, where the cutting members 44 and 60 are configured to be able to cut food in either direction as food is passed over the cutting members 44 and 60.

Figure 7:
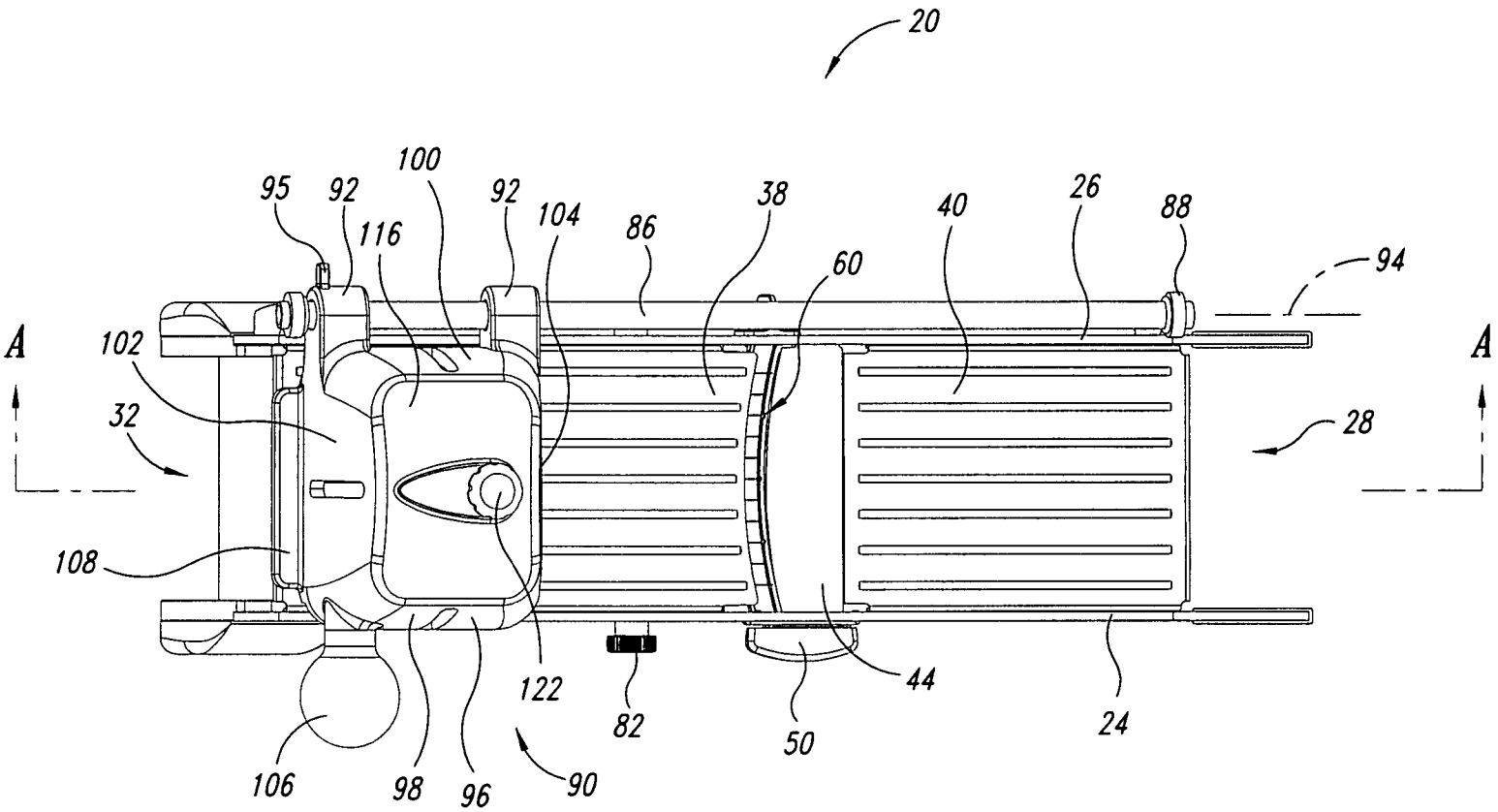
FIG. 7 is a top view of a mandolin slicer according to an embodiment showing an underside of the slicer.
Figure 8:
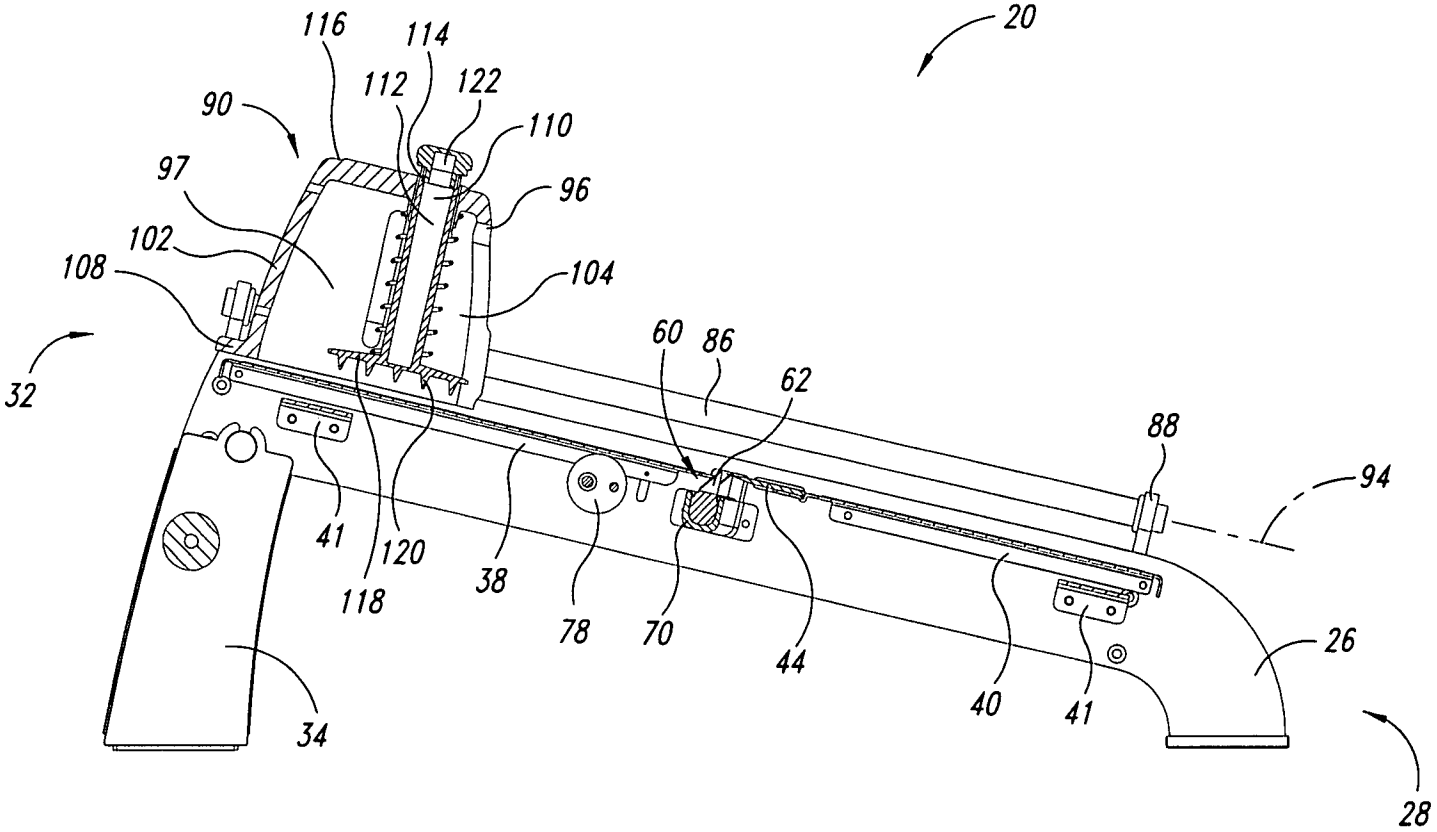
FIG. 8 is a sectional side view of the mandolin slicer in FIG. 7 taken along section A-A.
Figure 9:
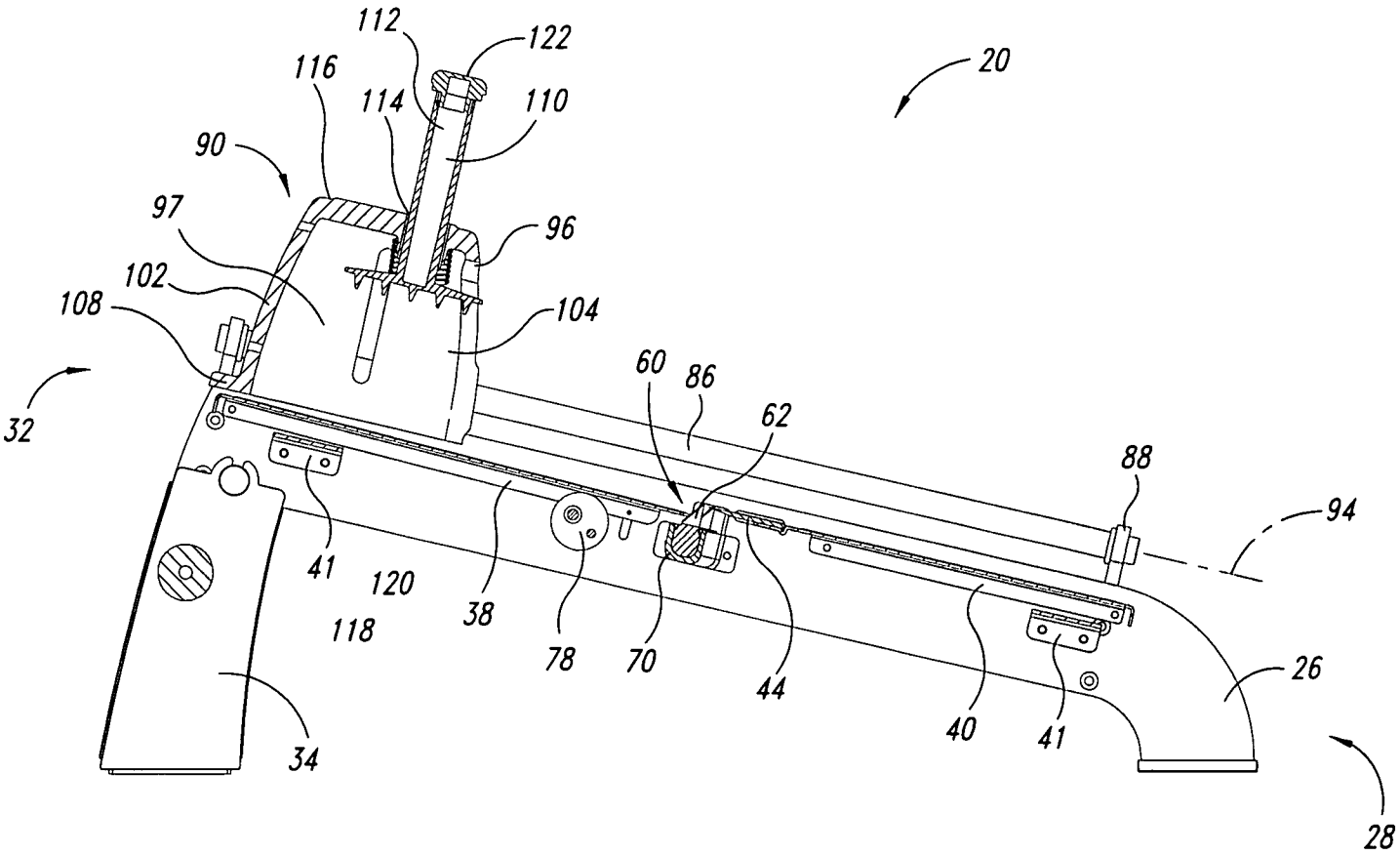
FIG. 9 is a sectional side view of the mandolin slicer in FIG. 7 taken along section A-A with the plunger raised and first food support surface moved.
Figure 10:
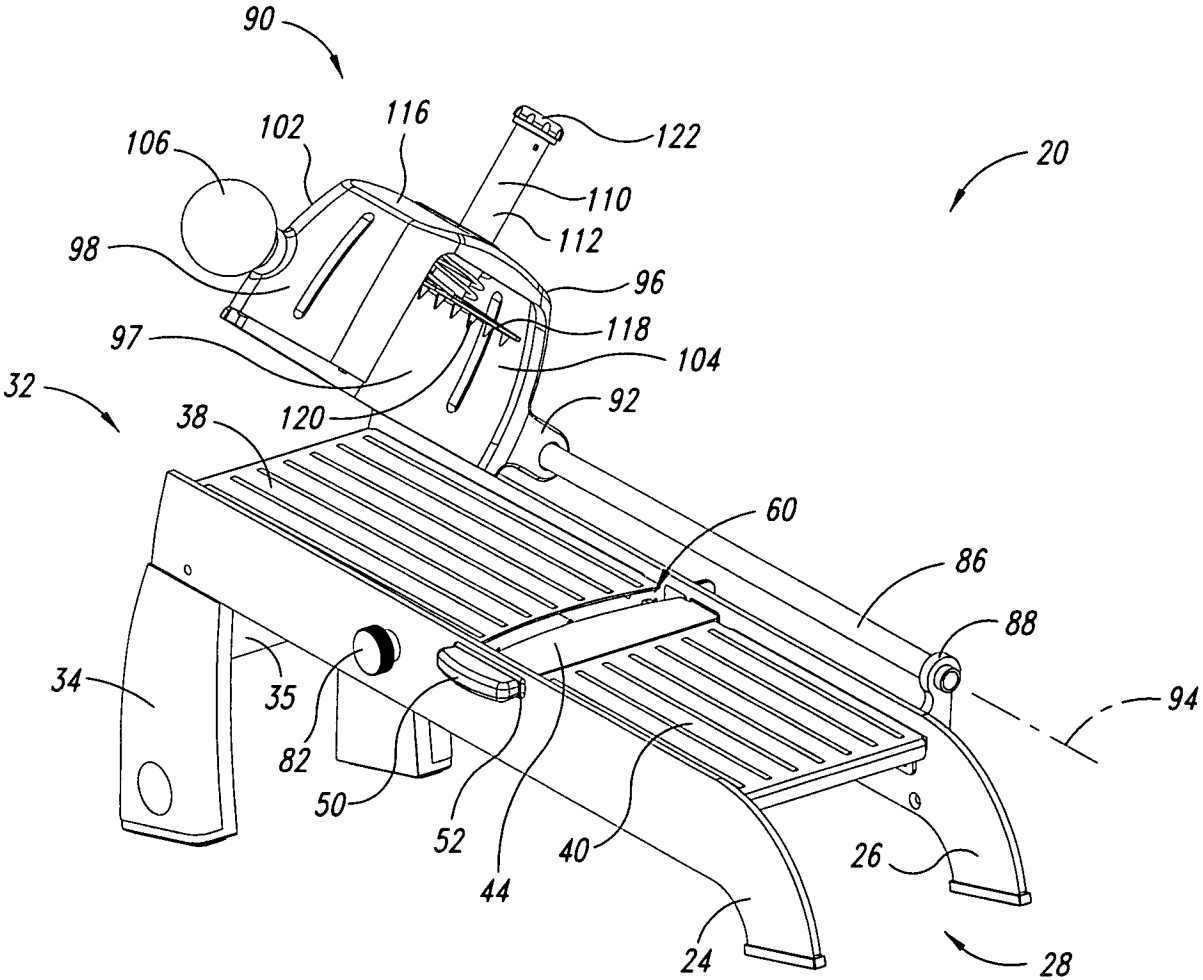
FIG. 10 is a perspective view of a mandolin slicer according to an embodiment with a food carrier rotated and a plunger displaced upwards, with the food carrier over a first food support surface.
Figure 11:
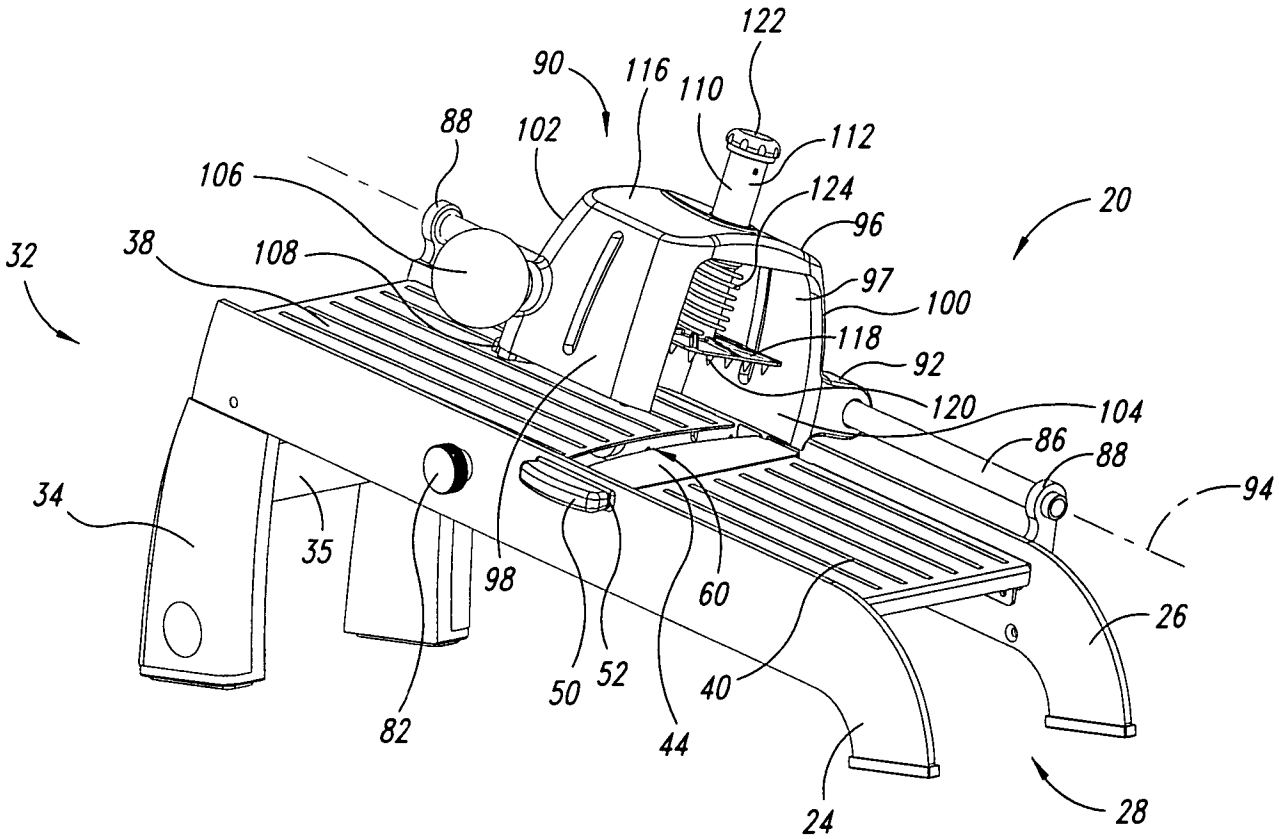
FIG. 11 is a perspective view of a mandolin slicer according to an embodiment with the food carrier rotated and a plunger displaced upwards, with the food carrier having been moved over cutting members.
Figure 12:
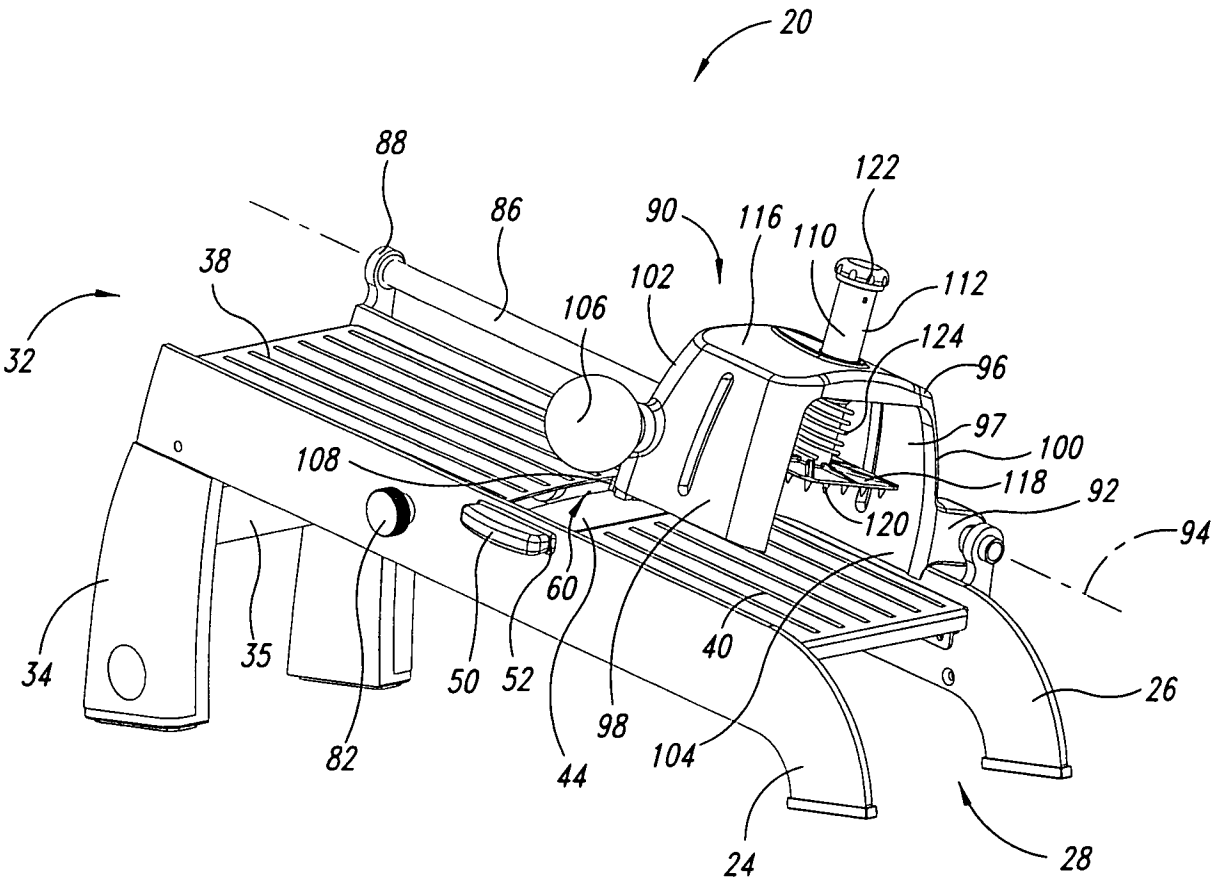
FIG. 12 is a perspective view of a mandolin slicer according to an embodiment with a food carrier rotated and a plunger displaced upwards, with the food carrier over a second food support surface.

With reference to FIGS. 7-9, when the adjustment knob 80 is rotated, the camshaft 76 and cam 78 are rotated because they are in mechanical communication with the adjustment knob 80. Thus, when the adjustment knob 80 is rotated, the cam 78 pushes onto the forward end 84 of the first food support surface 38, thereby causing an angle to change between the first food support surface 38 relative to the cutting member 44. The change in angle with respect to the first food support surface 38 and the cutting member 44 can be selected to improve the feeding action and slicing of a food article passed across the cutting member 44, and to reduce drag and sticking of the food article on the first and second food support surfaces 38 and 40 or the cutting member 44.

In some embodiments, the angle with respect to the first food support surface 38 and the cutting member 44 will only change slightly, with a difference of about zero to ten degrees in a half-revolution of the adjustment knob 80 and cam 78. In embodiments, the angle change will produce a difference in slicing thickness of about between about zero and about half an inch in a complete revolution of the adjustment knob 80 and cam 78. For example, if the cam 78 is in position 1 (shown in FIG. 8), a first angle is formed between the first food support surface 38 and the cutting member 44. When the cam 78 is in position 2 (shown in FIG. 9), a second angle is formed between the first food support surface 38 and the cutting member 44, in which the second angle is greater than the first angle. Because the second angle is greater than the first angle, when a food article is slid across the first food support surface 38 and the cutting member 44, the slice of food created thereby is greater than it would be with the first angle. In embodiments, the first food support surface 38 and the cutting member 44 lie in substantially parallel planes and the vertical distance may vary in the vertical dimension with the first food support surface 38 and the cutting member 44 still remaining in substantially parallel planes. In embodiments, the first food support surface 38 and the cutting member 44 can be substantially coplanar. In other embodiments, the first food support surface 38 may be configured with a slicing thickness mechanism that has a plurality of adjustment knobs 80 coupled to a plurality of camshafts 76 disposed along the underside of the first food support surface 38 so that the entire length of the first food support surface 38 may be raised or lowered together. In these embodiments, the first food support surface 38 is coupled to the front and back rails 24 and 26 such that the first food support surface 38 may move up and down as a unit.

In embodiments, the camshaft 76 and cam 78 are located at a selected distance away from the rotatable coupling of the rearward end 85 of the first food support surface 38 near the cutting member 44 since a greater distance provides increased sensitively in adjustment of the slicing thickness mechanism 74 and the angle change between the first food support surface 38 relative to the cutting member 44, and better user control for finer vertical spacing through adjustment of the adjustment knob 80.

Referring to FIGS. 7-15, in embodiments a carrier rail 86 (also called a food carrier rail) is provided along one side of the mandolin slicer 20. In embodiments, the carrier rail 86 is coupled to the back rail 26 and extends transversely along the elongated body of the back rail 26. For example, the carrier rail 86 extends along and substantially in a plane parallel with the first and second food support surfaces 38 and 40 and the cutting member 44. The carrier rail 86 can also be co-planar with or disposed in a plane above or below a plane of the first or second food support surfaces 38 and 40 or the cutting member 44. In embodiments, the carrier rail 86 is made of stainless steel tubing and is rigidly affixed to the back rail 26 by fasteners 88. In other embodiments, the carrier rail 86 is an integral portion of one of the food support surfaces 38 and 40 or of the rails 24 and 26.

A food carrier 90 is coupled to the carrier rail 86. The food carrier 90 is slidable along the carrier rail 86 between a first position over the first food support surface 38, the first position near the proximate end 32 of the mandolin slicer 20, and a second position over the second food support surface 40, the second position near the distal end of the mandolin slicer 20. In embodiments, the food carrier is coupled to the carrier rail 86 via circular couplings 92 that encircle the carrier rail 86. The food carrier 90 can be coupled to the carrier rail 86, for example, via linear bearings to provide a smooth sliding motion along the carrier rail 86. Alternatively, bushings, such as of bronze or Teflon® may be employed instead of the bearings. The food carrier 90 may be permanently attached to the carrier rail 86 or may be removably attached for cleaning and maintenance.

The food carrier 90 is also rotatably coupled to the carrier rail 86 (shown for example in FIGS. 10-12) such that the food carrier 90 can be rotated around a longitudinal axis 94 of the carrier rail 86. This rotatable coupling of the food carrier 90 to the carrier rail 86 is accomplished by the circular couplings 92. Other fasteners may be used to couple the food carrier 90 to the carrier rail 86 as long as the fasteners allow the food carrier 90 to transversely slide along the carrier rail 86 and to rotate around the longitudinal axis 94 of the carrier rail 86.

In embodiments, the food carrier 90 can be provided with a locking mechanism 95 (shown for example in FIG. 7) such that, when lifted and twisted to a selected angle, the food carrier 90 can be locked in the lifted position by the locking mechanism 95 with the food carrier 90 still able to be slid along the carrier rail 86. In an embodiment, the locking mechanism 95 is part of one or more of the circular couplings 92. In an embodiment, the locking mechanism 95 is a detent stop.

The food carrier 90 has a housing 96 that is generally trapezoidal defining a housing space 97 therein. The food carrier 90 has generally rectangular opposing side walls 98 and 100 that can be configured to rest upon any combination of the first and second food support surfaces 38 and 40 and/or the front and back rails 24 and 26. In one embodiment, the food carrier 90 is configured with the side wall 98 that can rest upon the front rail 24 and the opposing side wall 100 that is coupled to the circular couplings 92 that are attached to the carrier rail 86. In this embodiment, the opposing side wall 100 does not directly rest on the food support surfaces 38 and 40 or the rails 24 and 26 because it is supported by the carrier rail 86. In other embodiments, one or more of the opposing side walls 98 and 100 can rest on one or more of the food support surfaces 38 and 40 or the rails 24 and 26.

The food carrier 90 also has a generally rectangular back wall 102 and a substantially open front portion 104, where the back wall 102 faces the proximate end 32 of the mandolin slicer 20 and the front portion 104 faces the distal end 28 of the mandolin slicer 28. The front portion 104 of the food carrier 90 is open to allow a food article inside the food carrier 90 to stick out. This is advantageous for food articles that have a length dimension that is greater than a length of the food carrier 90 housing 96. In alternative embodiments, the front portion 104 has a wall portion. In other embodiments, the housing 96 of the food carrier 90 can be any shape that is configured to move a food article along the first and second food support surfaces 38 and 40 and over the cutting members 44 and 60.

A handle 106 is coupled to the food carrier 90 to permit a user to move the food carrier 90 along the mandolin slicer 20, including over the first and second food support surfaces 38 and 40 and the cutting members 44 and 60. A user can also use the handle 106 to lift and rotate the food carrier 90 around the longitudinal axis 94 of the carrier rail 86. Rotating the food carrier 90 is advantageous because it allows a user to place an oversized food article on the mandolin slicer 20 underneath a portion of the food carrier 90 that would not otherwise fit within the space 97 in the housing 96 of the food carrier 90.

The handle 106 is also advantageously coupled to the side wall 98, where the handle 106 extends out from the food carrier 90. When the food carrier 90 is resting on the mandolin slicer 20, such as when the side wall 98 is resting on the front rail 24, the handle 106 extends out in a plane perpendicular to the side wall 98. This advantageous placement of the handle 106 provides safety for a user operating the mandolin slicer 20 because the handle substantially operates and moves back in forth in a plane that does not intersect with the cutting members 44 and 60. This minimizes the chances of a user cutting their hand on the cutting members 44 and 60. In embodiments, the handle 106 is shaped substantially like a ball. Other embodiments of the handle 106 can have any desirable shape, such as an ergonomic curved shape or a shape having an elongated portion with spaces curved out for fingers to wrap around.

In embodiments, back wall 102 of the food carrier 90 is configured with a stop tab 108 that extends out from a lower portion of the back wall 102 in a plane perpendicular from the back wall 102. The stop tab 108 is designed to help prevent or discourage a user from putting their hand or fingers on the first or second food support surfaces 38 and 40 when operating the mandolin slicer 20. This helps further prevent a user accidentally cutting their hand or fingers on the cutting members 44 and 60 while moving the food carrier 90 and cutting food. In embodiments, the stop tab 108 forms the lowermost portion of the back wall 102 and is disposed high enough above the first or second food support surfaces 38 and 40 when the food carrier 90 is in a fully down position, for example when the side wall 98 is resting on the front rail 24 in certain embodiments, that the stop tab 108 does not contact the cutting members 44 and 60 when the food carrier 90 passes over the cutting members 44 and 60.

The food carrier 90 is equipped with a plunger 110 having an elongated portion 112 extending inside the housing 96. In embodiments, the plunger 110 is a glass filled nylon spike. In embodiments, the plunger 110 is made of plastic so that if the plunger 110 happens to come in contact with the cutting members 44 and 60 during operation of the mandolin slicer 20, damage to the cutting members 44 and 60 is minimized. In other embodiments, the plunger 110 is mode of any desirable material, including metal or polymer.

The elongated portion 112 includes an upper portion that is configured to pass through an opening 114 on a top cover 116 of the food carrier 90, and the elongated portion 112 has a bottom portion ending at a plunger pad 118 opposite the top cover 116 of the food carrier 90. The plunger pad 118 has a generally flat bottom surface with a plurality of gripping points 120, the gripping points 120 having a generally pointed end configured to press into a food article when the plunger pad 118 is placed on the food article. The elongated portion 112 of the plunger is configured to have at least a portion of its length slidably pass through the opening 114 in the top cover 116. A top portion of the elongated portion 112 is removably coupled to a plunger cap 122, where the plunger cap 122 is above the top cover 116 of the food carrier 90.

The plunger 110 is also configured in embodiments with a spring 124 that wraps around the elongated portion 112 of the plunger 110. One end of the spring 124 presses against an inside surface of the top cover 116 of the housing 96 and the other end of the spring 124 presses against the plunger pad 118, thereby pressing and biasing the plunger pad 118 in the downward direction towards the first and second food support surfaces 38 and 40. The downward bias of the spring 124 on the plunger pad 118 is designed to put a downward force on a food article that is underneath the plunger pad 118. The spring 124 can be selected to provide a desirable force to hold the food article firmly on the first and second food support surfaces 38 and 40 as the food carrier 90 is slid along the carrier rail 86 and to maintain the hold as the food article thins with each successive slice across the cutting members 44 and 60.

In embodiments, the spring 124 may be removed from the plunger 110 by removing the plunger cap 122, removing the plunger 110 from the food carrier 90, and sliding the spring 124 off of the elongated portion 112 of the plunger 112. A user may then put the plunger 112 back into the food carrier 90 and recouple the plunger cap 122 to the elongated portion 112 of the plunger 112. When the spring 124 is removed from the plunger 112, a downward force can be exerted on a food article in the food carrier 90 by either the weight of the plunger 112 and plunger pad 118 pressing down on the food article or a force from a user pushing down on the plunger 112, such as a user pushing down on the plunger cap 122 from the top of the food carrier 90. A user may also apply this additional force in embodiments having a spring 124, where the user can apply additional pressure on a food article by pressing down on the plunger 112 via the plunger cap 122.

Figure 13:
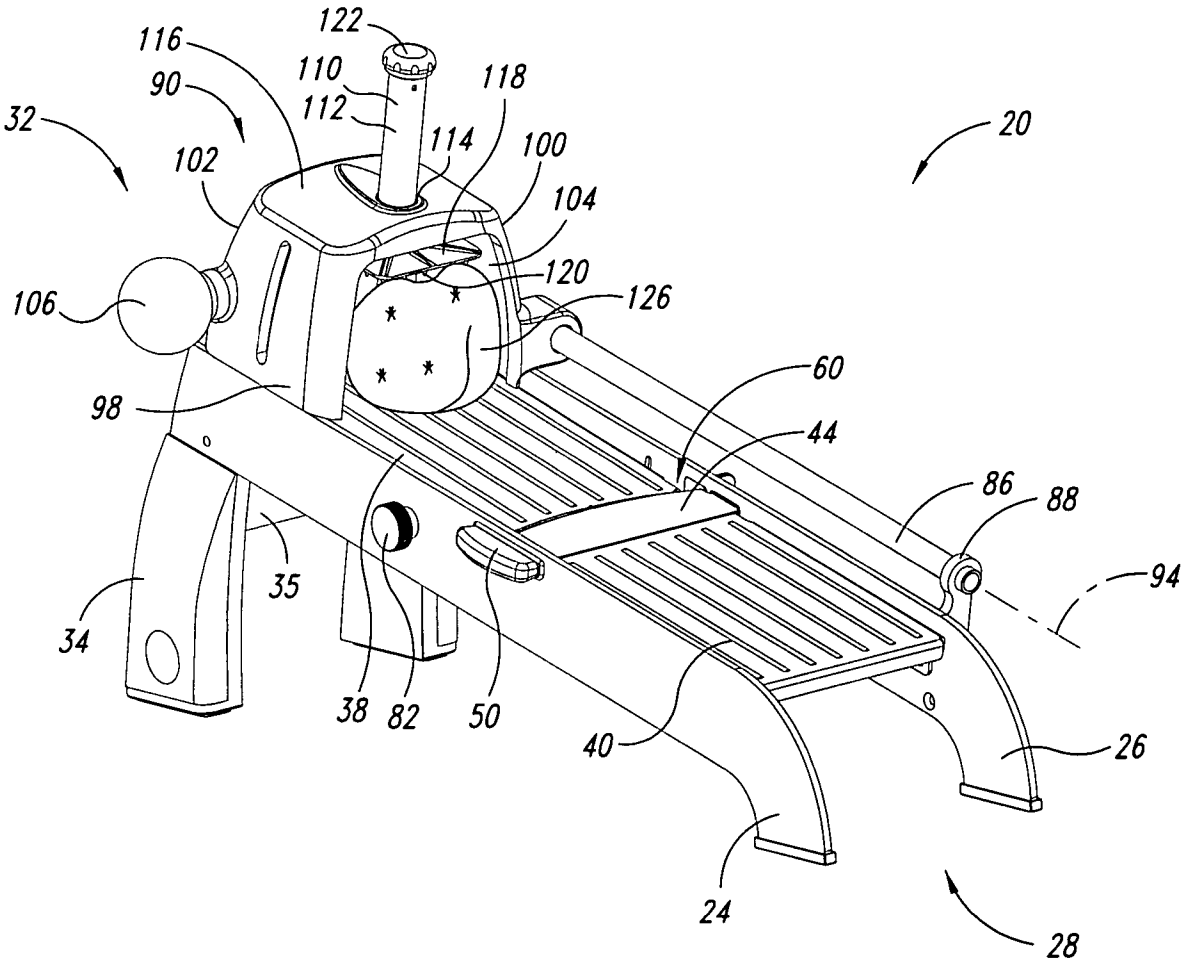
FIG. 13 is a perspective view of a mandolin slicer according to an embodiment with a food article in a food carrier and a plunger displaced upwards with the food carrier over a first food support surface.
Figure 14:
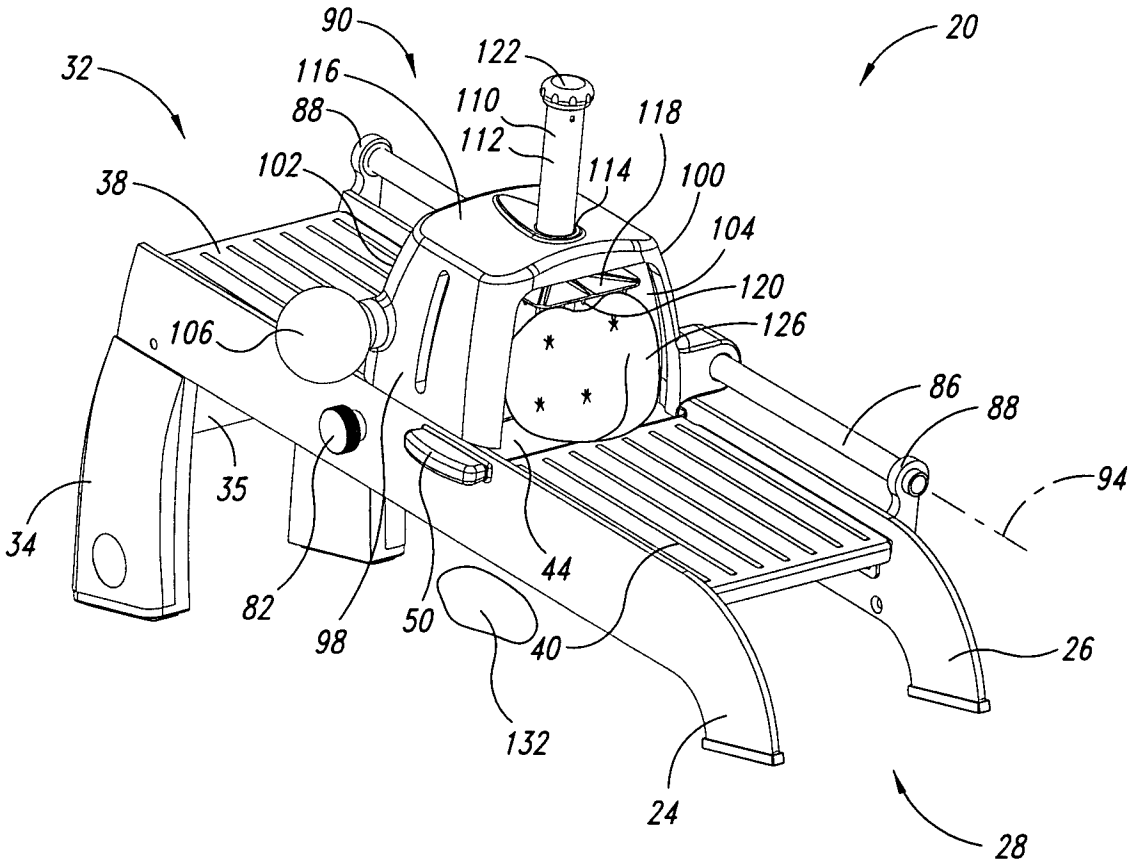
FIG. 14 is a perspective view of a mandolin slicer according to an embodiment with a food article in a food carrier and a plunger displaced upwards with the food carrier and food article moved over the cutting members and a food slice is below the mandolin slicer.
Figure 15:
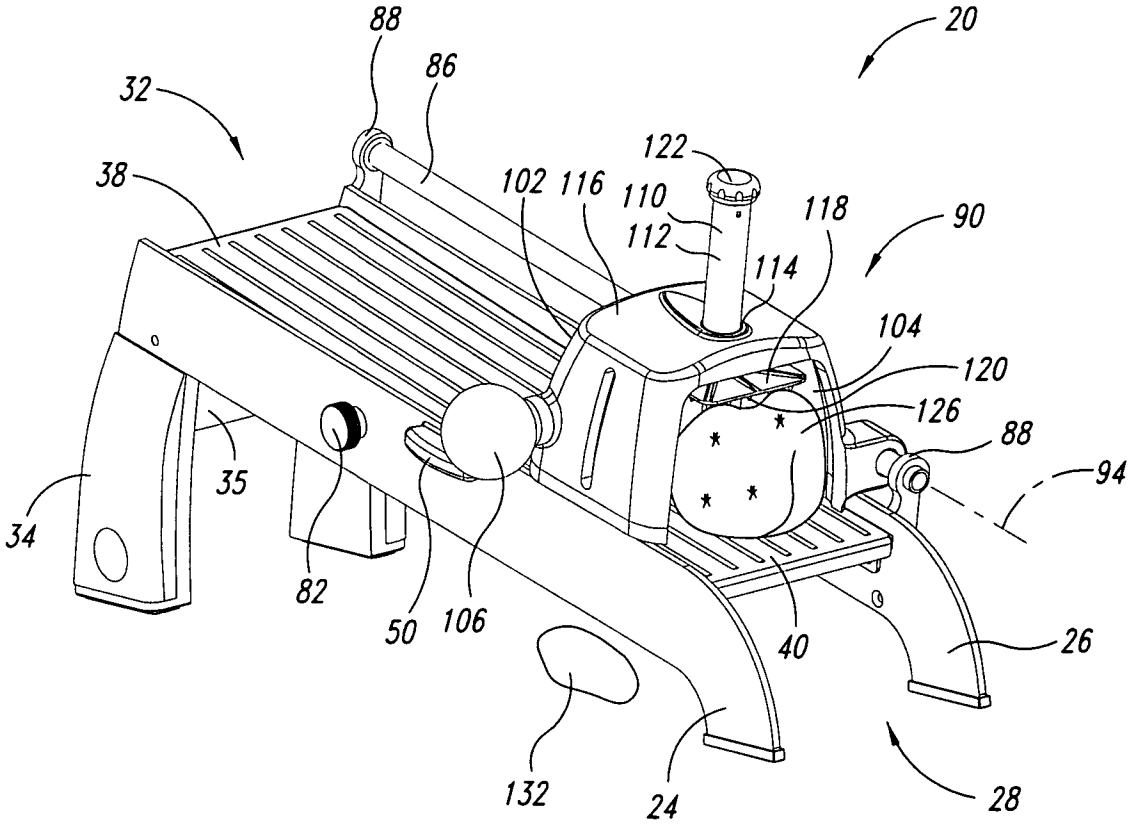
FIG. 15 is a perspective view of a mandolin slicer according to an embodiment with a food article in a food carrier and a plunger displaced upwards, with the food carrier over a second food support surface and a food slice is below the mandolin slicer.

With reference to FIGS. 13-17, an exemplary embodiment, operation of the mandolin slicer 20 is shown. A user operates the mandolin slicer 20 by gripping the handle 106 and rotating the food carrier 90 away from the food support surfaces 38 and 40 (shown for example in FIG. 10). A user then places a food article 126 to be sliced, for example a potato as depicted in FIGS. 13-15, on the first food support surface 38 and rotates the food carrier 90 over the food article allowing the plunger pad 118 and gripping points 120 to press down on the food article 126. The food carrier 90 then rests on the rail 24 and over the first food support surface 38, shown for example in FIG. 13.

The user then grips the handle 106 with one hand and grips the stabilizing bar 35 with the other hand and slides the food carrier 90 towards the cutting members 44 and 60 and the second food support surface 40, thereby passing the food article across the cutting members 44 and 60, shown for example in FIG. 14. Gripping the stabilizing bar 35 allows a user to substantially prevent the mandolin slicer 20 from moving as the food carriage 90 is moved back and forth. As the food article passes over the cutting edge 48 of the cutting member 40 going towards the second food support surface 40, a slice 132 is removed from the food article at the thickness set by the slicing thickness mechanism 74. The slice 132 is deposited below the mandolin slicer 20, where it can fall into a receptacle (not shown).

After the food carrier 90 is passed over the cutting member 44 and 60, the user moves the food carrier 90 to the distal end 28 of the slicer 20 and over the second food support surface 40, shown for example in FIG. 15. The user can then return the food carrier 90 back to the starting point at the proximate end 32 of the slicer where the food carrier 90 is over the first food support surface 38. The user can repeat the movement, sliding the food carrier 90 back and forth across the first and second food support surfaces 38 and 40, thereby slicing the food article 126 with the cutting members 44 and 60.

Figure 16:
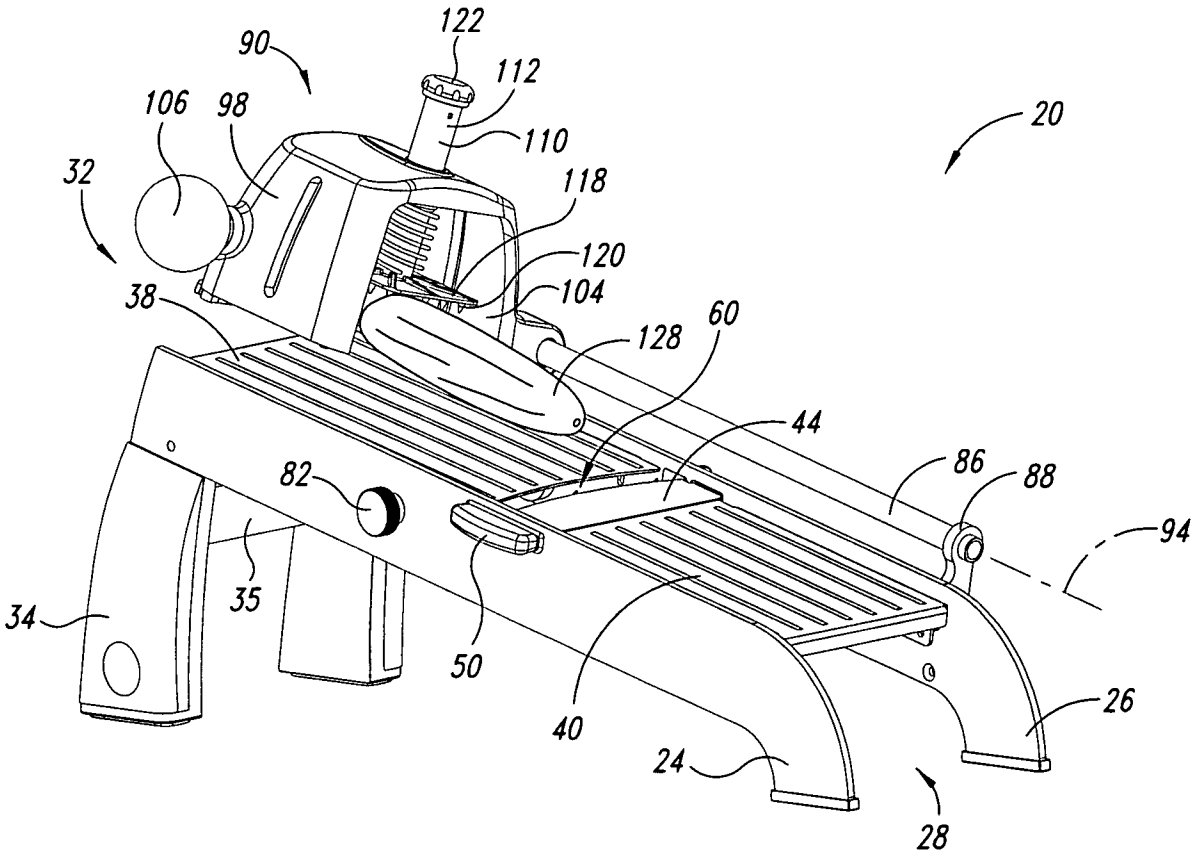
FIG. 16 is a perspective view of a mandolin slicer according to an embodiment with a long food article in a food carrier rotated and a plunger displaced upwards with the food carrier over a first food support surface.
Figure 17:
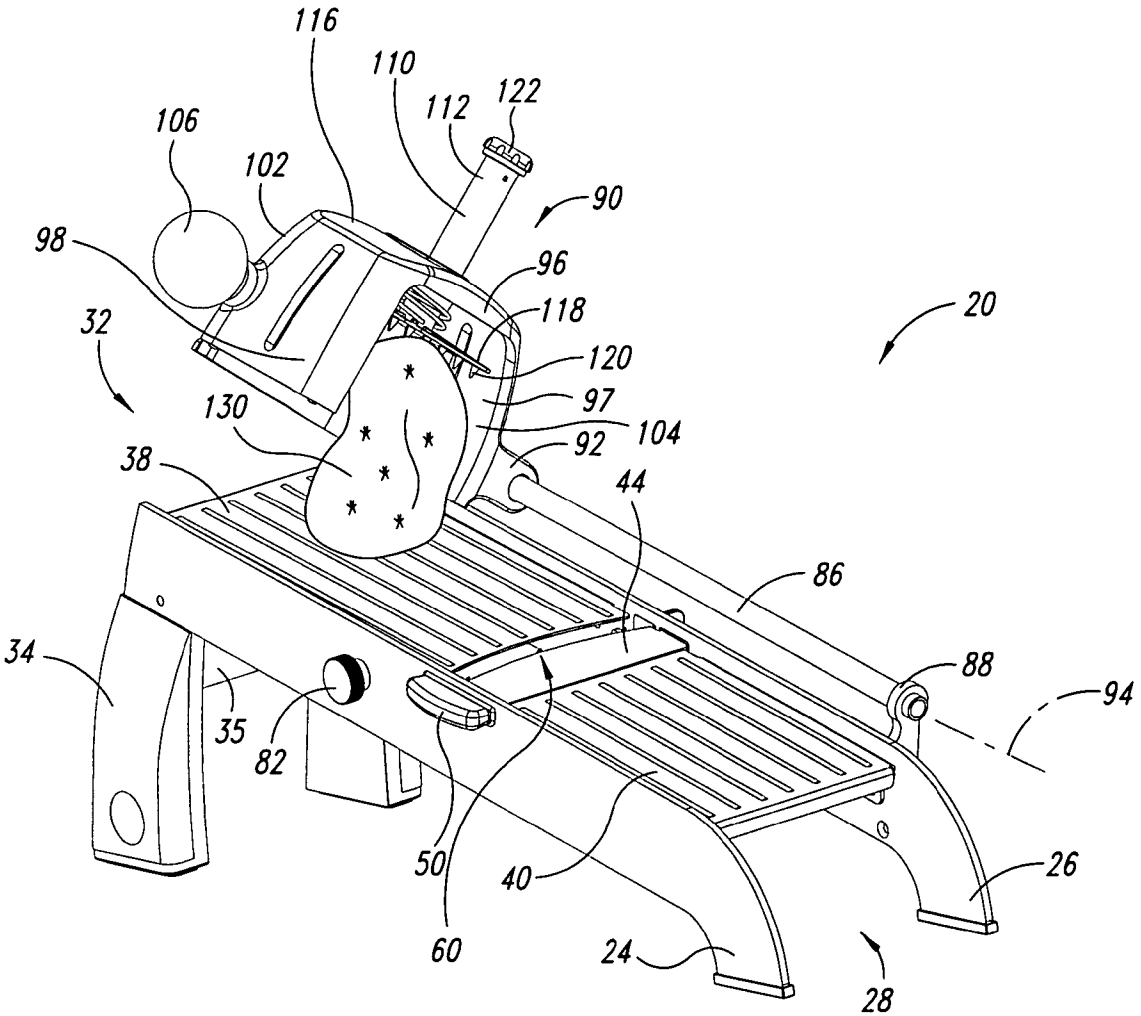
FIG. 17 is a perspective view of a mandolin slicer according to an embodiment with an oversized food article in a food carrier and a plunger displaced upwards with the food carrier over a first food support surface.

The food carrier 90 is a significant improvement over the prior art, not only because of its significant and novel safety features, also because it easily and safely cuts a long food article 128 (shown for example in FIG. 16) and an oversized food article 130 (shown for example in FIG. 17). A long food article 128, for example a cucumber as depicted in FIG. 16, extends outside the food carrier 90. The front portion 104 of the food carrier 90 is open so that a portion of the long food article 128 can fit underneath and be held by the food carrier 90 and plunger pad 118 during operation.

An oversized food article 130, for example a large potato as depicted in FIG. 17, has a height greater than a height of the food carrier 90 such that when the food carrier 90 rests on top of the food article, the side wall 98 of the food carrier 90 is not able to rest on the front rail 24. The oversized food article 130 is still held in place, however, by the food carrier 90.

A user can rotate the food carrier 90 away from the food support surfaces 38 and 40 and place the long or oversized food articles 128 and 130 on the first food support surface 38. The user then can rotate the food carrier 90 over the long or oversized food articles 128 and 130 allowing the plunger pad 118 and gripping points 120 to press down on against a corner or side portion of the long or oversized food articles 128 and 130, exerting a downward pressure on the long or oversized food articles 128 and 130 and holding it against the first and second food support surfaces 38 and 40. The user then grips the handle 106 with one hand and grips the stabilizing handle 35 with the other hand and slides the long or oversized food articles 128 and 130 with the food carrier 90 back and forth across the first and second food support surfaces 38 and 40, thereby passing the long or oversized food articles 128 and 130 across the cutting members 44 and 60, thereby cutting the long or oversized food articles 128 and 130 at a thickness set by the slicing thickness mechanism 74.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A mandolin cutter, comprising:

a frame having a first frame member and a second frame member;

a first food support surface and a second food support surface, the first and second food support surfaces between the first and second frame members;

a cutting member configured to be inserted into and removed from a space between the first and second food support surfaces, the cutting member having a cutting edge;

a food carrier rail coupled to the first frame member, the food carrier rail extending substantially parallel to, separate from and higher than the first and second food support surfaces;

a food carrier having a first sidewall, a second sidewall opposite the first side-wall, a back wall extending between the first sidewall and the second sidewall, and an open front portion, the food carrier rotatably coupled to the food carrier rail near the first sidewall and configured to receive a food article and to be movable along the food carrier rail to pass over the first and second food support surfaces when the food carrier is moved along the food carrier rail;

a slicing thickness adjustment mechanism configured to vary a vertical distance between the cutting edge of the cutting member and the first food support surface; and a handle coupled to a lower end of the second sidewall of the food carrier opposite the first sidewall, near the back wall and remote from the open front portion and the food carrier rail to allow a user to move the food carrier translationally along the food carrier rail, the handle extending from the lower end of the second sidewall of the food carrier such that, when the lower end of the second sidewall of the food carrier rests on the frame and the mandolin cutter is viewed from overhead, the handle is laterally offset from the cutting member, and the handle being positioned relative to the food carrier such that during a cutting operation a path of the handle does not pass directly above the cutting member and such that a user may apply a downward and forward directed force to the handle off to the side of the food carrier in a location adjacent where the lower end of the second sidewall of the food carrier rests on the frame.

2. The mandolin cutter of claim 1 wherein the food carrier rail comprises a metal tube rigidly affixed to the first frame member, the food carrier rail having a length that is approximately as long as the first and second food support surfaces combined.

3. The mandolin cutter of claim 1, further comprising at least one fastener coupled to the first frame member and the food carrier rail, wherein the at least one fastener is separate from and extends higher than the first and second food support surfaces, and wherein the at least one fastener holds at least of a portion of the food carrier rail separate from and higher than the first and second food support surfaces.

4. The mandolin cutter of claim 1 wherein the cutting member comprises a blade, the blade being removably coupled to the first and second frame members.

5. The mandolin cutter of claim 4 wherein the blade comprises a substantially flat blade having a substantially convex, sharpened edge that is the cutting edge, the cutting edge proximate the first food support surface and the blade being substantially coplanar with the second food support surface.

6. The mandolin cutter of claim 1 wherein the cutting member further includes a plurality of blades disposed vertically in a plurality of planes perpendicular to the first and second food support surfaces.

7. The mandolin cutter of claim 1 wherein the first and second food support surfaces each comprise a plurality of substantially parallel guide ribs running along a length of the first and second food support surfaces, wherein the guide ribs are configured to provide a surface for at least a portion of a food article to be resting thereupon.

8. The mandolin cutter of claim 1 wherein the food carrier is configured to press a food article downward upon the first and second food support surfaces when a user moves the food carrier translationally along a length of the food carrier rail from the first to the second food support surface.

9. The mandolin cutter of claim 8 wherein the food carrier comprises a spring-loaded plunger configured to press the food article down.

10. The mandolin cutter of claim 1 wherein the slicing thickness adjustment mechanism comprises a cam shaft traversing the frame and carrying a cam configured to adjust a vertical distance between a trailing edge of the first food support surface and the cutting edge of the cutting member.

11. The mandolin cutter of claim 10 wherein the vertical distance between the trailing edge of the first food support surface and the cutting edge of the cutting member can vary between about zero to about one-half inch in vertical distance.

12. A mandolin slicer, comprising:

a frame having a first frame member and a second frame member;

a first food support surface and a second food support surface, the first and second food support surfaces between the first and second frame members;

a plurality of elongated cutting members each configured to be inserted into and removed from a space between the first and second food support surfaces, wherein at least one of the plurality of elongated cutting members is configured to accommodate a vertically disposed blade;

a food carrier rail coupled to the first frame member, the food carrier rail extending separate from and higher than the first and second food support surfaces;

a food carrier having a first sidewall, a second sidewall opposite the first side-wall, a back wall extending between the first sidewall and the second sidewall, and an open front portion, the food carrier rotatably coupled to the food carrier rail near the first sidewall and configured to receive a food article and to be movable along the food carrier rail to pass over the first and second food support surfaces when the food carrier is moved along the food carrier rail;

a plurality of fasteners coupled to and between the first frame member and the food carrier rail, wherein the plurality of fasteners are separate from and extend higher than the first and second food support surfaces, and wherein the plurality of fasteners hold the food carrier rail separate from and higher than the first and second food support surfaces;

a slicing thickness adjustment mechanism configured to vary a vertical distance between a cutting edge of one or more of the plurality of cutting members and the first food support surface; and a handle coupled to a lower end of the second sidewall of the food carrier opposite the first sidewall, near the back wall and remote from the open front portion and the food carrier rail to allow a user to move the food carrier translationally along the food carrier rail, the handle extending from the lower end of the second sidewall of the food carrier such that, when the lower end of the second sidewall of the food carrier rests on the frame and the mandolin cutter is viewed from overhead, the handle is laterally offset from the cutting member, and the handle being positioned relative to the food carrier such that during a cutting operation a path of the handle does not pass directly above the cutting member and such that a user may apply a downward and forward directed force to the handle off to the side of the food carrier in a location adjacent where the lower end of the second sidewall of the food carrier rests on the frame.

13. The mandolin slicer of claim 12, further comprising an opening on a side portion of the first frame member and an opening on a side portion of the second frame member, wherein the openings on the side portions of the first and second frame members are configured to provide access for one or more of the plurality of elongated cutting members to be inserted into and removed from the space between the first and second food support surfaces.

14. The mandolin slicer of claim 13, wherein the side portions of the first and second frame members are lower than the food carrier rail.

15. A mandolin cutter, comprising:

a frame having a first frame member and a second frame member;

a first food support surface and a second food support surface, the first and second food support surfaces between the first and second frame members;

a cutting member between the first and second food support surfaces, the cutting member having a cutting edge;

a food carrier rail coupled to the first frame member, the food carrier rail extending substantially parallel to the first and second food support surfaces;

a food carrier having a first sidewall, a second sidewall opposite the first side-wall, a back wall extending between the first sidewall and the second sidewall, and an open front portion, the food carrier rotatably coupled to the food carrier rail near the first sidewall and configured to receive a food article and to be movable along the food carrier rail to pass over the first and second food support surfaces when the food carrier is moved along the food carrier rail;

a slicing thickness adjustment mechanism configured to vary a vertical distance between the cutting edge of the cutting member and the first food support surface; and a handle coupled to a lower end of the second sidewall of the food carrier opposite the first sidewall, near the back wall and remote from the open front portion and the food carrier rail to allow a user to move the food carrier translationally along the food carrier rail, the handle extending from the lower end of the second sidewall of the food carrier such that, when the lower end of the second sidewall of the food carrier rests on the frame and the mandolin cutter is viewed from overhead, the handle is laterally offset from the cutting member, and the handle being positioned relative to the food carrier such that during a cutting operation a path of the handle does not pass directly above the cutting member and such that a user may apply a downward and forward directed force to the handle off to the side of the food carrier in a location adjacent where the lower end of the second sidewall of the food carrier rests on the frame.

16. The mandolin cutter of claim 15 wherein the frame includes a pair of legs at a rear end of the mandolin cutter and the mandolin cutter further comprises a stabilizing handle extending between the pair of legs.

* * * * *